United States Patent [19]

Buhayar

[11] Patent Number: 4,709,607

[45] Date of Patent: Dec. 1, 1987

[54] ROTARY CUTTER BLADE CLAMP

[76] Inventor: Eric S. Buhayar, P.O. Box 309, Swarthmore, Pa. 19081

[21] Appl. No.: 485,566

[22] Filed: Apr. 15, 1983

[51] Int. Cl.[4] ..... B26B 1/40

[52] U.S. Cl. ..... 83/342; 83/345; 83/347; 83/672; 83/696; 144/218; 144/230

[58] Field of Search ..... 83/345, 343, 347, 342, 83/672, 696; 144/230

[56] References Cited

U.S. PATENT DOCUMENTS

| | | | |
|---|---|---|---|
| 3,559,705 | 2/1971 | Salzmann | 144/218 X |
| 3,709,077 | 1/1973 | Trogan et al. | 83/342 |
| 4,004,479 | 1/1977 | Bodnar | 83/347 |

FOREIGN PATENT DOCUMENTS

| | | | |
|---|---|---|---|
| 814580 | 6/1959 | United Kingdom | 144/230 |

*Primary Examiner*—Donald R. Schran

[57] ABSTRACT

A holder for mounting a knife blade in a rotating roll. The holder comprises a plural pairs of clamp members for holding a knife blade with its interior edge against a reference in a rotating roll so as to adjustably position the cutting edge of the blade along the length of the roll. Each clamp member has opposed planar surfaces for contacting a segment of the blade and each clamp member is adjustable to position its planar surface in a direction generally perpendicular to the plane of the blade. Each clamp member is also adaptable to align its planar surface to the blade direction along the length of the roll as a clamping force is applied. When clamped, the blade contacting surface of at least one of each pair of clamp members has a fixed angle so as to resist a cutting force acting perpendicular to the plane of the blade at its cutting edge.

2 Claims, 6 Drawing Figures

ROTARY CUTTER BLADE CLAMP

TECHNICAL FIELD

This invention relates generally to the field of clamping a blade in a rotary cutter or scissors and more particularly to a segmented clamp assembly for individually setting the planar angle and position of plurality of segments of the blade.

BACKGROUND ART

One prior art rotary cutter uses an arrangement for clamping a cutting blade in a roll 18 as illustrated in FIG. 2. The blade 11 is mounted in a blade holder 13. Plural pairs of axially aligned set screws 15, and 17 apply a clamping force to the blade holder 13 in order to retain the blade 11 within the blade holder 13. The blade holder 13 is mounted within cut out 19 in the roll 18. The thickness of the cut out 19 is larger than the thickness of the blade holder 13 which allows the position and direction of the blade holder to change down the length of the roll. Since the blade holder 13 is flexible, when all of the pairs of set screws 15, 17 have been adjusted, the shape of the cutting edge of the blade 11 will not necessarily be a straight line. One disadvantage of the prior art clamping arrangement is caused by the fact that the set screws 15, 17 do not have perfectly flat faces but tend to concentrate the clamping force about a relatively small area surrounding the axes 23 of the set screws 15, 17. As a result, any force, as represented by the arrow 27, acting on the blade 11 not only bends the blade 11 but tends to rotate the blade holder 13 about axis 29, which runs along the length of blade 12, and intersects the axes of set screws 15 and 17. In addition, because the slot 31 in blade holder 13 must be larger than the thickness of the blade 11, even when the blade 11 is clamped, there is some tendency for the plane of the blade 11 to pivot about the axis 29. Because of this tendency of the plane of the blade 11 and blade holder 13 to rotate about an axis parallel to the length of the blade 11, that portion of the blade 11 that projects from blade holder 13 does not resist the force F in a true built-in cantilever fashion.

I have found that it is desirable to have a blade holder that minimizes the tendency of the clamped portion of the blade to rotate about an axis parallel to the length of the blade in response to bending forces F acting on the blade 11.

SUMMARY OF INVENTION

This invention deals with a holder for mounting a knife blade in a rotating roll. The holder comprises plural pairs of clamp members for holding a knife blade with its interior edge against a reference in a rotating roll so as to adjustably position the cutting edge of the blade along the length of the roll. Each clamp member has opposed planar surfaces for contacting a segment of the blade and each clamp member is adjustable to position its planar surface in a direction generally perpendicular to the plane of the blade. Each clamp member is also adaptable to align its planar surface to the blade direction along the length of the roll as a clamping force is applied. When clamped, the blade contacting surface of at least one of each pair of clamp members has a fixed angle so as to resist a cutting force acting perpendicular to the plane of the blade at its cutting edge.

One disadvantage of the prior art blade holder is that the thickness of the slot in the blade holder is greater than the thickness of the blade which means that the bottom end of the blade is free to move a little bit within the blade holder. In the subject invention the planar face of each clamp member is adjusted not only to establish the plane of the blade segment clamped there between but also to assure that the planar face of each clamp member is in full contact with the surface of the blade so that the blade segment, when clamped, cannot rotate about an axis parallel to the length of the blade.

BRIEF DESCRIPTION OF THE DRAWINGS

While the specification concludes with claims particularly pointing out and distinctly claiming that which is regarded as the present invention, the objects and advantages of this invention can be more readily ascertained from the following description of preferred embodiments when read in conjunction with the accompanying drawings in which:

BEST MODE FOR CARRYING OUT THE INVENTION

For the sake of convenience, certain elements described with reference to a specific figure will retain the same reference designation in the description of subsequent figures.

Figure 1:
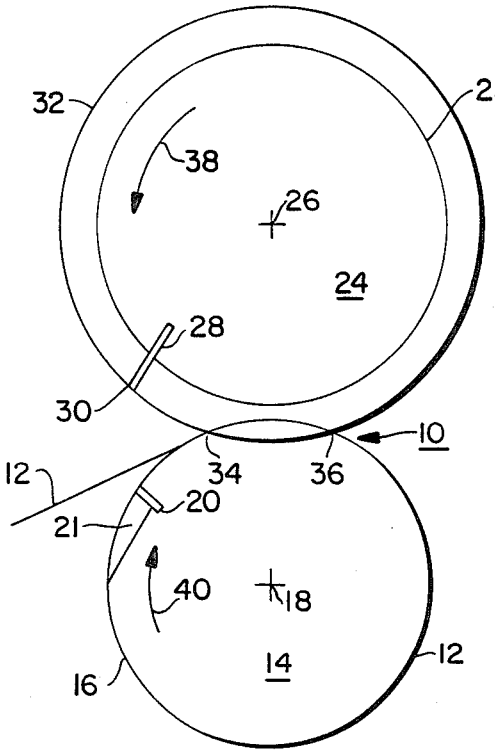
FIG. 1 PRIOR ART
FIG. 1 is a schematic representation of a typical prior art rotary cutter.
Figure 2:
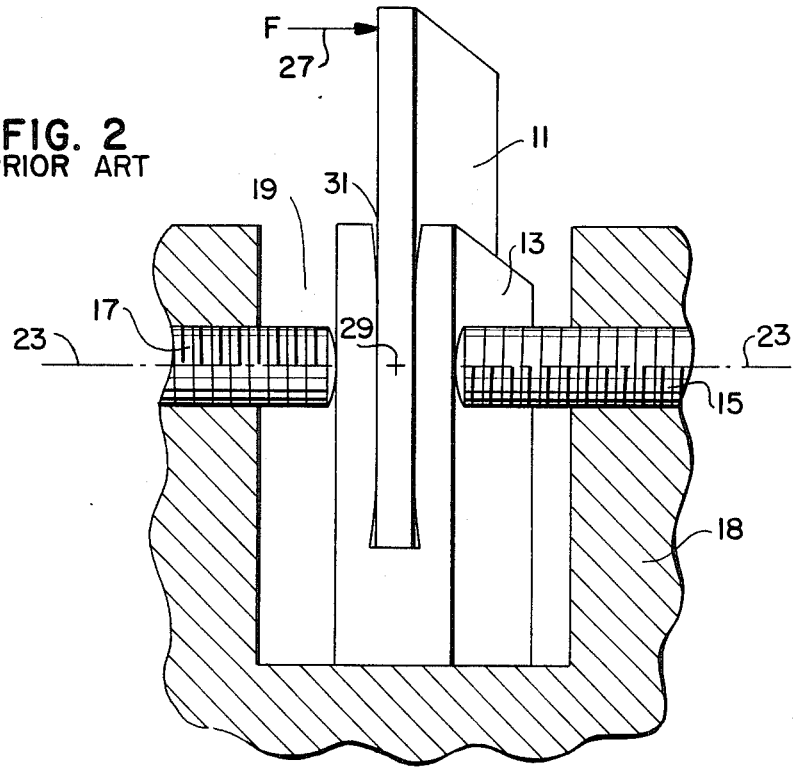
FIG. 2 PRIOR ART
FIG. 2 illustrates a prior art blade clamping arrangement.

FIG. 1 depicts in schematic form a typical prior art rotary cutter or scissor. A web material 12 is directed onto the surface 16 of an anvil roll (sometimes also called a bed roll) 14 rotating about a central axis 18. Mounted in the anvil roll 14 is an anvil blade 20 having its cutting edge 22 at or just below the surface 16 of the anvil roll 14. The rotary cutter or scissor 10 includes a fly knife roll 24 rotating about a central axis 26. Mounted within the fly knife roll 24 is a fly knife blade 28 having a cutting edge 30 that projects beyond the surface 25 of the fly knife roll 24. The anvil roll 14 rotates in a clockwise direction as indicated by arrow 40 and the fly knife roll 24 rotates in a counter clockwise direction as indicated by the arrow 38. For ease of explanation, assume that the anvil blade 20 is mounted so that the locus described by its cutting edge 22 as the anvil roll 14 rotates about its center axis 18 is a circle that coincides with the surface 16 of the anvil roll 14. The circle 32 represents the locus of the cutting edge 30 of fly knife blade 28 as the fly knife roll 24 rotates about its center axis 26. The locus of a point on the cutting edge 30 of fly knife blade 28 intersects the locus of a point on the cutting edge 22 of anvil blade 20 at an intersection point 34. The web material 12 will be cut when the cutting edge 22 of the anvil blade 20 meets the cutting edge 30 of fly knife blade 28 at intersection point 34.

Figure 4:
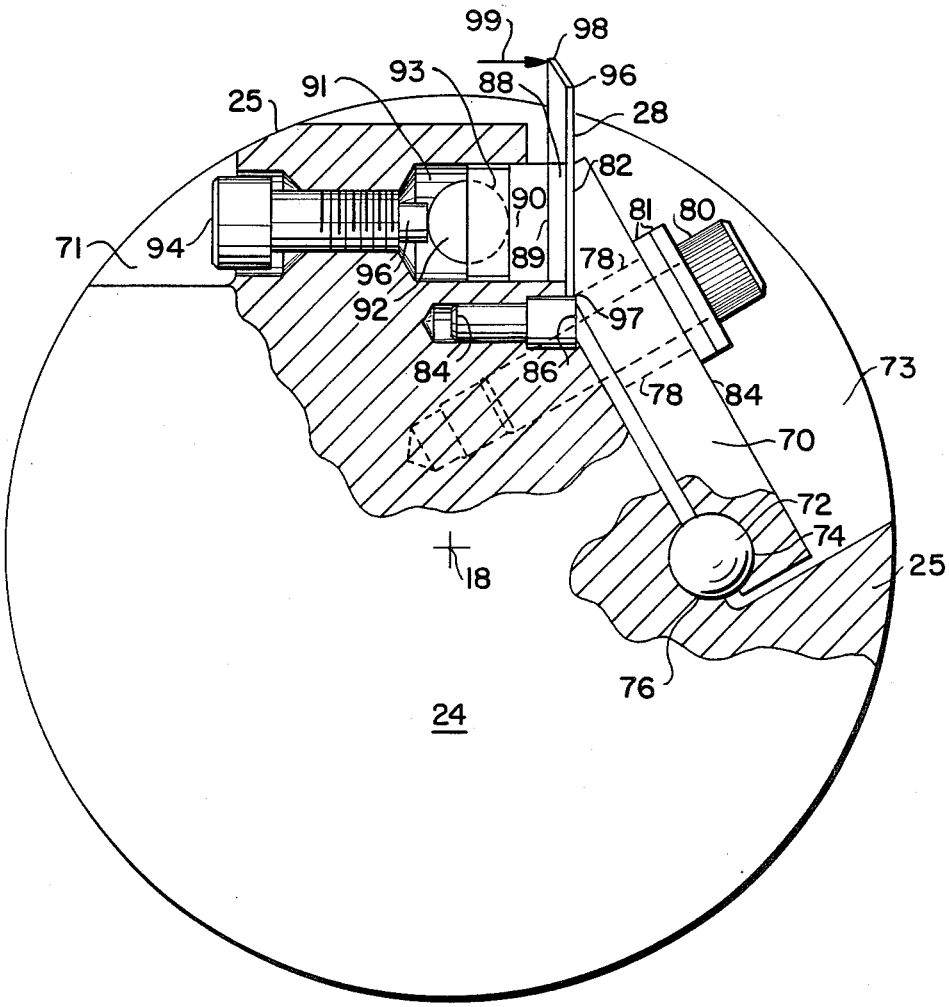
FIG. 4 shows an end view, partially in section, of another means for clamping a rotating blade.
Figure 5:
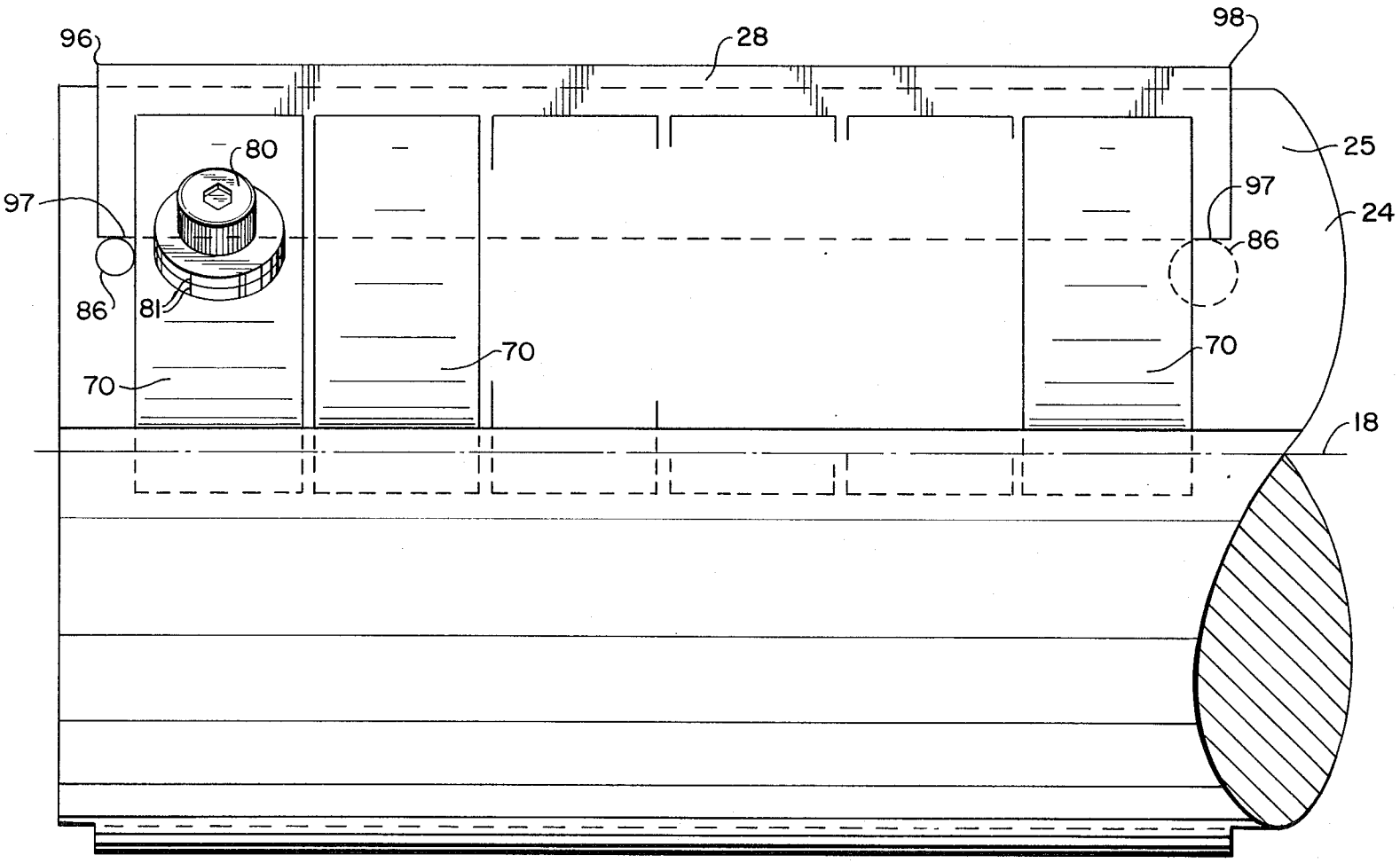
FIG. 5 is a side view of the clamp means illustrated in FIG. 4.

FIGS. 4 and 5 illustrate a preferred means for clamping a rectangular fly knife blade 28 in the fly knife roll 24. The blade 28 is mounted in the roll 24 so that one corner 98 of the blade 28 extends further from the surface 25 of the fly knife roll 24 than does the other corner 96 of the blade 28. The blade 28 is mounted in the fly knife roll 24 so that the inner edge 97 of the blade 28 rests against the heads 86 of two reference buttons 84. The diameters of the heads 86 of the reference buttons 84 determine the precise slope, or cant, of the cutting edge of the fly knife blade 28. The fly knife blade 28 is held within the fly knife roll 24 by six individually adjustable clamp assemblies, each clamp assembly being able to control the position of a segment of the fly knife blade 28 along the length of the fly knife roll 24. As shown in FIG. 4, portions 71, 73 of the fly knife roll 24 have been cut away so that all parts of the individual clamp assemblies will lie within the locus of the surface 25 of the fly knife roll 24. Each clamp assembly includes a clamp segment 70 which has a planar face 82 that contacts one surface of fly knife blade 28. At the other end of clamp segment 70, a ball 72 cooperates with a spherical cut out 74 in the clamp segment 70 and a spherical cut out 76 in the fly knife roll 24 to form a ball and socket joint. The clamp segment 70 includes a bearing surface 84 which forms an acute angle with the plane of the surface of the fly knife blade 28. The fly knife roll 24 is threaded to receive socket head cap screw 80 which passes through spherical washers 81 and through clearance hole 78 within clamp segment 70. The spherical washers 81 act to uniformly distribute the bolt forces on the bearing surface 84 even though the plane of bearing surface 84 is not perpendicular to the axis of the socket head cap screw 80. A clamping force is applied to the other surface of fly knife blade 28 by the planar face 89 of a plunger 90 which fits loosely within a cylindrical cavity 91 in the fly knife roll 24. The end of the plunger 90 opposite from the planar face 89 has a spherical cut out 93 adapted to receive a ball 92. The clamping force is provided by the end 96 of the socket head cap screw 94 which applies pressure on ball 92 and plunger 90. Although the planar face 89 of plunger 90 could directly contact the surface of fly knife blade 28, it is preferred to employ a blade spacer 88 made of a softer material than either the planar face 89 of plunger 90 or the fly knife blade 28. The blade spacer 88 prevents corrosion fretting fatigue of the working surfaces of the plunger 90 and the fly knife blade 28. In a preferred embodiment, the blade spacer 88 runs the entire length of the fly knife blade 28 in order to help distribute the clamping load more evenly along the blade 28 in particular over discontinuities. Because the diameter of the cylindrical cavity 91 is larger than the diameter of the plunger 90, and because the clamping force is provided through a ball 92 and socket arrangement, the plane of the face 89 of plunger 90 will align itself to match the plane of face 82 of clamp segment 70 as the clamping force is first applied by socket head cap screw 94.

After the socket head cap screws 80, 94 have been tightened to firmly clamp a segment of the fly knife blade 28 between the planar surfaces 82. 89, the planar surfaces 82, 89 and the segment of the fly knife blade 28 clamped there between all have the same planar angle which is fixed. A cutting force, represented by the arrow 99 in FIG. 4 applied to the cutting edge of fly knife blade 28 is unable to cause either the fly knife blade 28 or the planar surface 82 of clamp member 70 to rotate about an axis parallel to the axis 18 of the fly knife roll 24 because socket head cap screw 80 and spherical washers 81 prevent clamp member 70 from rotating about an axis parallel to the axis 18 of the fly knife roll 24 and because there are sufficient clamping forces applied to plunger 90 to maintain its planar surface 89 in contact with the surface of the blade 28 and in planar alignment with the planar surface 82 of clamp member 70. It should also be mentioned that although each segment of the blade between surfaces 82, 89 is planar, the cutting edge of the blade 28 may tend to adopt a curvilinear shape as the blade extends through adjacent segments.

Figure 6:
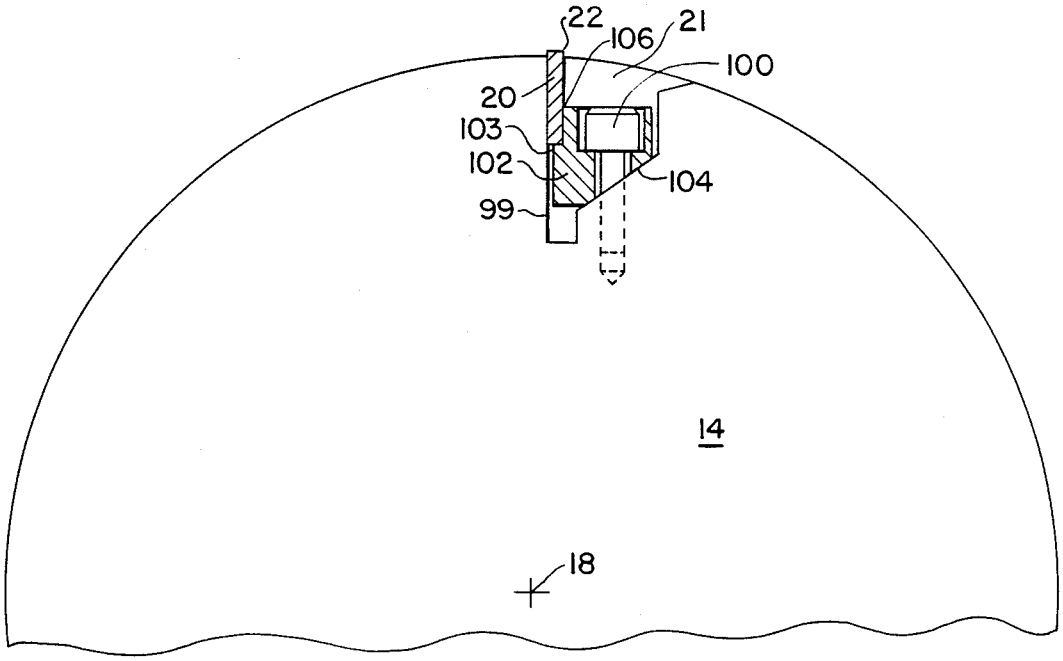
FIG. 6 is an end view, partially in section, illustrating a preferred means for mounting the anvil blade in the anvil roll.

FIG. 6 shows a preferred means for mounting an anvil blade 20 within an anvil roll 14. A cavity 21 is formed in the anvil roll 14. Within the cavity 21 is formed a side wall 99 against which one surface of anvil blade 20 will be clamped. The cavity 21 also includes a surface 104 that is inclined with respect to surface 99. A clamping force is applied to the anvil blade 20 by means of a clamp bar 102 that has a inclined surface that bears on inclined surface 104 within cavity 21. The clamp bar 102 is held within the cavity 21 by means of bolt 100. The holes in clamp bar 102 that receive the bolt 100 and the head of bolt 100 are drilled with sufficient clearance so that as bolt 100 is tightened, the surface 106 of clamp bar 102 bears laterally against the surface of anvil blade 20 thereby clamping it within the anvil roll 14. The clamp bar 102 also has a ledge 103 for locating the interior edge of anvil blade 20.

Figure 3:
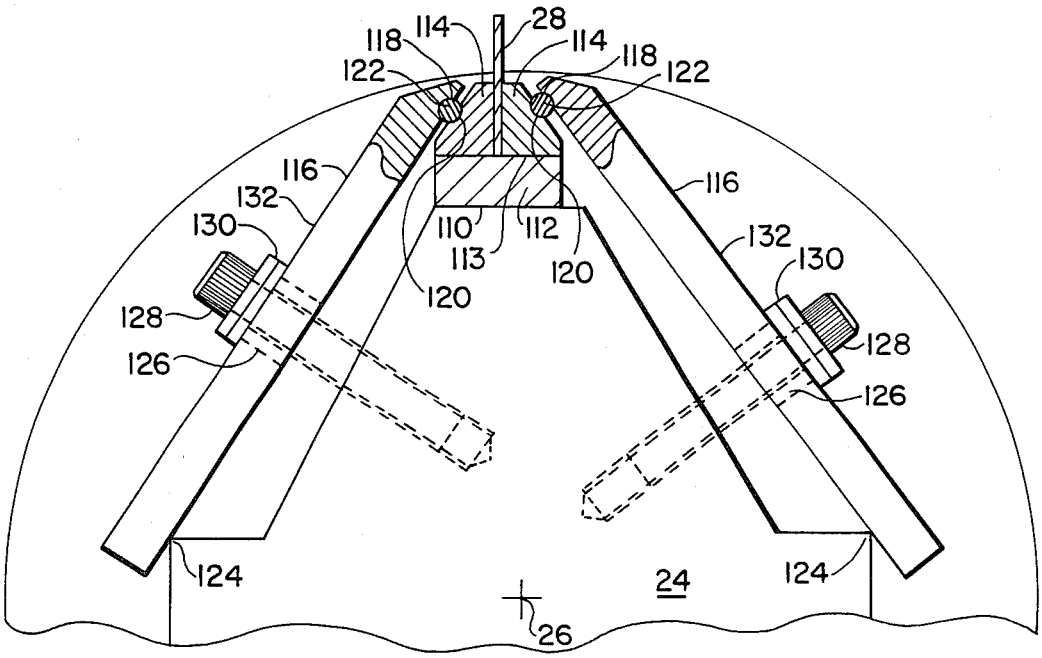
FIG. 3 shows an end view, partially in section, of means for clamping a blade in a roll.

Referring now to FIG. 3, which is an end view, partially in section, depicting another clamping arrangement in accordance with this invention. In this clamping arrangement, a wedge 112 sits on surface 110 of fly knife roll 24. The upper surface 113 of wedge 112 acts as a reference surface for fly knife blade 28. The slope of surface 113 establishes the cant of the cutting edge of the fly knife blade 28 along the length of the fly knife roll 24. Also resting on the upper surface 113 of wedge 112, located on each side of fly knife blade 28 are plural pairs of gripping blocks 114. The face of each gripping block 114 that contacts the surface of fly knife blade 28 is a plane that is at right angles to the surface of the gripping block 114 that rests on surface 113 of wedge 112. A clamping force is applied to fly knife blade 28 and gripping block 114 through a ball and socket arrangement formed by spherical surface 120 in gripping block 114, ball 122 and spherical surface 118 in the tip of clamp finger 116. The other end of clamp finger 116 rests on a shoulder 124 of fly knife roll 24. The location of shoulder 124 with respect to ball 122 is such that a bearing surface 132 of clamp finger 116 makes an angle with the face of fly knife blade 28. The clamping force is applied to clamp finger 116 by means of a socket head cap screw 128 which passes through a clearance hole 126 in clamp finger 116 and screws into fly knife roll 24. The clamping force is applied from the head of cap screw 128 to the bearing surface 132 through spherical washers 130 which provides even distribution of the clamping force on bearing surface 132 even though the plane of bearing surface 132 is not perpendicular to the axis of cap screw 128.

The clamping force applied to the gripping block 114 through the ball 122 can be resolved into two components, one that is perpendicular to the width of the blade and acting to compress the blade between the gripping blocks 114, and a second perpendicular component which stabilizes the gripping blocks 114 against the surface 113 of the wedge 112.

As in the prior embodiment, a plurality of such clamp means are employed along the length of fly knife blade 28. Because the planar face of gripping block 114 that contacts the face of fly knife blade 28 is perpendicular to the plane of gripping block 114 in contact with the sloped surface 113 of wedge 112, the segment of fly knife blade 28 that is clamped between the gripping blocks 114 will always be perpendicular to surface 113 of wedge 112.

It can be seen that the gripping blocks 114 can be positioned on the wedge 113 to position the cutting edge of the blade 28 along the length of the roll. The ball 122 and socket arrangement connecting the tip of clamping finger 116 to the gripping block 114 allows the planar surfaces of the gripping blocks 114 that contact the blade 28 surface to align in the direction of the blade 28 as the clamping forces are applied to the blade 28. Since components of the clamping force applied to the gripping block 114 are directed so as to maintain the gripping blocks 114 on the surface 113 of the wedge 112, and in contact with the segment of the blade 28, the blade 28 and the blade holding gripping blocks are unable to rotate about an axis parallel to the length of the blade 28.

Although FIG. 3 depicts similar clamp finger arrangements on both sides of fly knife blade 28, it will be apparent to those skilled in the art that the two clamp finger arrangements need not be similar. For example, the ball and plunger arrangement of FIGS. 4 and 5 could replace one of the clamp finger/gripping block arrangements for clamping fly knife blade 28.

The design choice of which of these various embodiments to use will be influenced by the space available around the fly knife blade 28 as it is located within the fly knife roll 24.

What is claimed is:

1. In a rotary cutter for cutting thin flexible web materials, the rotary cutter comprising a first blade, mounted in a roll rotating about a first axis, the first blade cooperating with a second blade, mounted for rotation about a second axis, an improved apparatus for clamping the first blade in the roll comprising plural pairs of clamp members for positioning individual segments of the blade along the length of the roll, each pair of clamp members having opposed planar surfaces for contacting a segment of the blade and each clamp member being (i) adjustable to position its planar surface in a direction generally perpendicular to the plan of the blade, and (ii) able to adjust the direction of its planar surface with respect to the axis of the roll; and when clamped, said opposed planar surfaces and the blade segment there between all have the same planar angle, one clamp member of each pair having at one end the blade contacting planar surface, the other end being connected to the roll by means of a ball joint, said one clamp member having a bearing surface and bolt means extending therethrough into the roll which when tightened exerts a clamping force on said bearing surface and on the blade surface.

2. A holder as recited in claim 1 wherein the other clamp member of each pair comprises a plunger loosely located in a recess of the roll, one end of the plunger having the blade contacting planar surface, the other end of the plunger adapted to receive a ball forming a ball joint and a bolt extending through the roll to apply a clamping force to the ball and to the blade surface and whereby the planar surface of the plunger aligns itself to be parallel to the planar surface of the one clamp member

* * * * *